United States Patent [19]

Kawakubo et al.

[11] Patent Number: 4,630,814

[45] Date of Patent: Dec. 23, 1986

[54] SHEET FEED APPARATUS FOR PRINTER

[75] Inventors: Toshio Kawakubo, Yokohama; Chuji Ishikawa, Kawasaki; Shizuo Yokoyama, Atsugi, all of Japan

[73] Assignee: Ricoh Company, Ltd., Tokyo, Japan

[21] Appl. No.: 599,428

[22] Filed: Apr. 12, 1984

[30] Foreign Application Priority Data

Apr. 13, 1983 [JP] Japan ..... 58-55290
Apr. 13, 1983 [JP] Japan ..... 58-55291
Apr. 13, 1983 [JP] Japan ..... 58-55293

[51] Int. Cl.[4] ..... B65H 5/02; B65H 5/04

[52] U.S. Cl. ..... 271/272; 226/199; 271/245; 400/639.1

[58] Field of Search ..... 271/272, 273, 274, 275, 271/314, 265; 226/91, 199, 196; 400/642, 647, 637.2, 637.6, 639.1

[56] References Cited

U.S. PATENT DOCUMENTS 4,294,556 10/1981 Rix ..... 226/196

FOREIGN PATENT DOCUMENTS 0107873 7/1982 Japan .

*Primary Examiner*—Joseph J. Rolla
*Assistant Examiner*—John A. Carroll
*Attorney, Agent, or Firm*—David G. Alexander

[57] ABSTRACT

A sheet feed apparatus suitable for use with a printer such as an ink jet printer. A flat guide member is disposed between paper bail rollers and a deflector to be movable toward and away from the periphery of a platen. The guide member is drivably controlled such that it faces the substantially entire peripheral area of the platen which extends between the paper bail rollers and the deflector only for a short period of time until a leading end portion of the sheet is retained between the paper bail rollers and the deflector.

15 Claims, 17 Drawing Figures

SHEET FEED APPARATUS FOR PRINTER

BACKGROUND OF THE INVENTION

The present invention relates to a sheet feed apparatus suitable for use with various kinds of printers and typewriters, particularly an ink jet printer.

A modern sheet feed apparatus for a printer includes paper bail rollers for pressing a sheet against a platen, a deflector for guiding the sheet along the platen, an elongate auxiliary guide member capable of assuming a position between the paper bail rollers and the deflector, and a solenoid for causing the auxiliary guide member into rotation. The upper end of the auxiliary guide member is located adjacent to the paper bail rollers so as to guide the leading end of the paper from the deflector to the paper bail rollers. After the leading end of the paper has been inserted between the paper bail rollers and the platen, the auxiliary guide member is rotated such that its upper end is moved clear of the paper bail rollers.

A problem encountered with a sheet feed apparatus of the type described above is that the elongate configuration of the auxiliary guide member makes it difficult to pass the paper around the platen. Such a configuration of the auxiliary guide member is unavoidable because the center of rotation of the guide member coincides with that of the platen and because pressure rollers for urging the paper against the platen are located in the rotating region of the auxiliary guide member.

SUMMARY OF THE INVENTION

It is therefore an object of the present invention to provide an improved sheet feed apparatus feasible for a printer or a typewriter, particularly an ink jet printer, which surely settles a sheet in a predetermined position on a platen by guiding and feeding the sheet along the periphery of the platen.

It is another object of the present invention to provide a sheet feed apparatus feasible for a printer or a typewriter, particularly an ink jet printer, which is excellent in durability and performance.

It is another object of the present invention to provide a sheet feed apparatus feasible for a printer or a typewriter, particularly an ink jet printer, which allows a motor for supplying a drive force to operate efficiently and insures positive coupling and uncoupling of a clutch mechanism, which serves to transmit the drive force, while enhancing the durability of the clutch mechanism.

It is another object of the present invention to provide a generally improved sheet feed apparatus feasible for a printer or a typewriter, particularly an ink jet printer.

A sheet feed apparatus for a printer which lays a sheet to print out data on a rotatable platen of the present invention comprises a platen drive device for rotating the platen, a deflector for guiding the sheet along a periphery of the platen, a paper bail roller for pressing the sheet against the periphery of the platen, a guide member movable to face the periphery of the platen between the paper bail roller and the deflector, a guide member drive device for integrally holding the guide member and moving the guide member toward and away from the periphery of the platen, and a control device for controlling the guide member drive device such that, after the guide member is moved toward the periphery of the platen between the paper bail roller and the deflector, the paper guide member is moved away from the periphery of the platen when a leading end of the sheet guided from the deflector to the paper bail roller is held between the paper bail roller and the platen.

The above and other objects, features and advantages of the present invention will become apparent from the following detailed description taken with the accompanying drawing.

DESCRIPTION OF THE PREFERRED EMBODIMENTS

Figure 1:
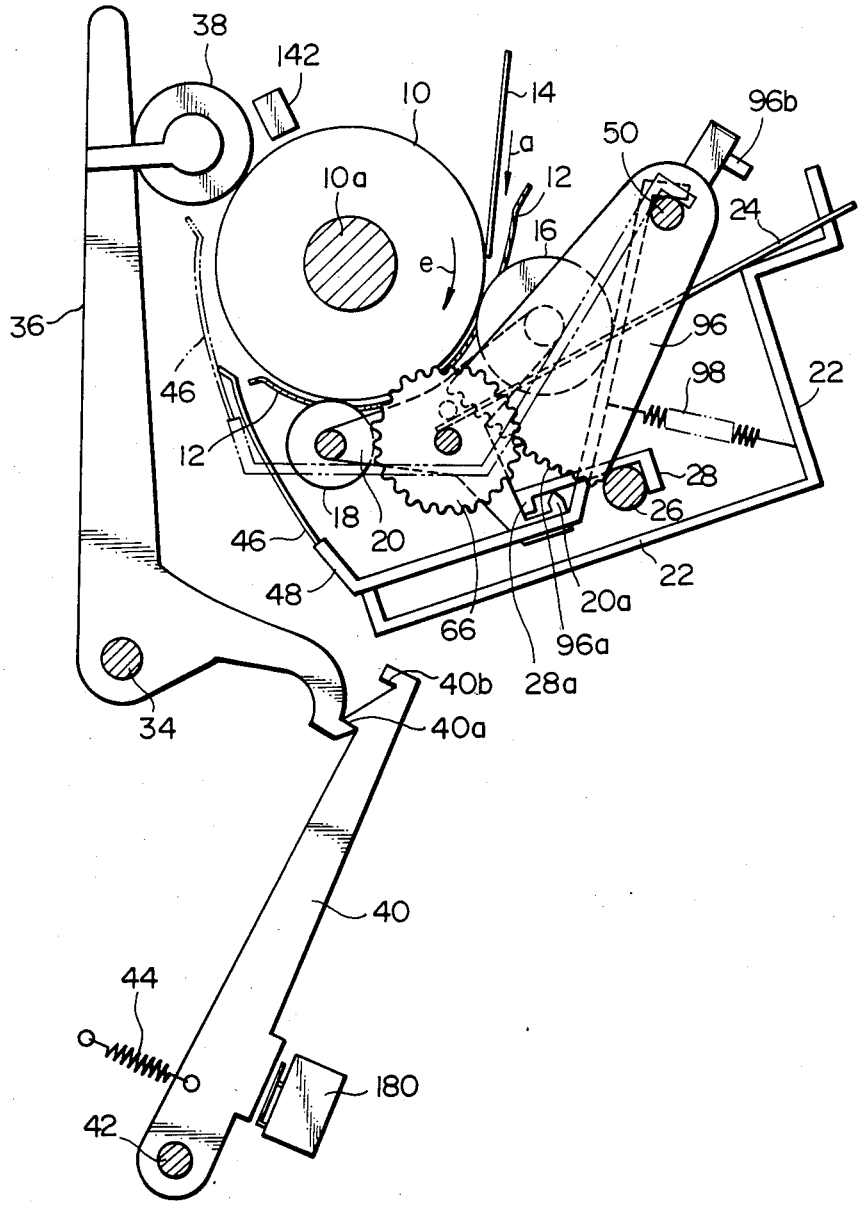
FIG. 1 is a fragmentary side elevation of a sheet feed apparatus for a printer embodying the present invention.

While the sheet feed apparatus for a printer of the present invention is susceptible of numerous physical embodiments, depending upon the environment and requirements of use, substantial numbers of the herein shown and described embodiments have been made, tested and used, and all have performed in an eminently satisfactory manner.

Referring to FIGS. 1–6, a sheet feed apparatus for a printer embodying the present invention is shown and includes a curved deflector 12 which extends along the periphery of a rotatable platen 10. The deflector 12 serves to guide along the platen 10 a sheet 14 which is inserted into the sheet feed apparatus as indicated by an arrow a. Pressure rollers 16 and 18 are arranged parallel to each other to individually face the platen 10 through openings which are formed in the deflector 12. The pressure rollers 16 and 18 are mounted on parallel shafts which are supported by a retainer 20. The retainer 20 is in turn constantly biased toward the platen 10 by a flat spring 24 which is securely anchored to a stationary member 22 at one end thereof, thereby keeping the pressure rollers 16 and 18 in pressing contact with the platen 10.

Figure 2:
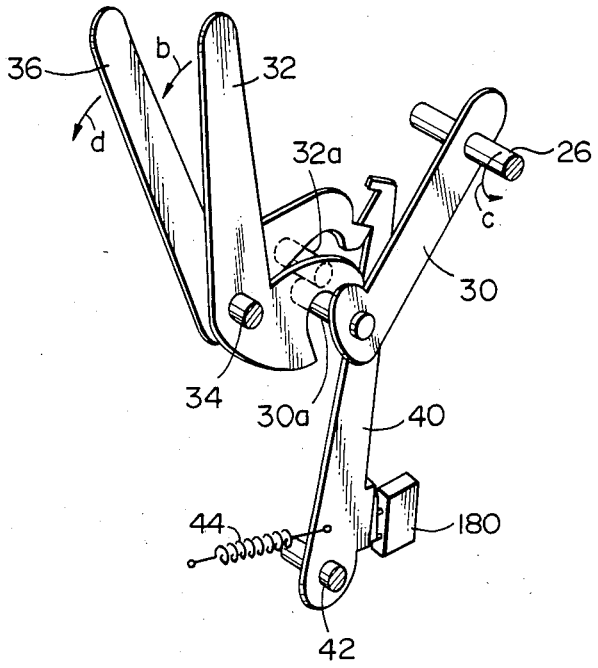
FIGS. 2 and 3 are views of part of the sheet feed apparatus shown in FIG. 1.

The retainer 20 is formed with an engaging portion 20*a* at the lower end thereof. Located near the engaging portion 20*a* is a rotatable shaft 26 which carries a release arm 28 rigidly therewith. The release arm 28 includes rotating end 28*a* which is engagable with the engaging portion 20*a* of the retainer 20. As shown in FIG. 2, a lever 30 is rigidly mounted on the rotatable shaft 26 at the upper end and has a projecting 30*a* at the lower end. A release lever 32 is rotatable about a support shaft 34 adjacent to the projection 30*a* and engaged with the projection 30*a* at the lower end thereof. When the release lever 32 is manually rotated at its upper end in a direction indicated by an arrow b, the lever 30 is rotated to angularly move its associated shaft 26 in a direction c. Then, the shaft 26 causes the release arm 28 to urge the engaging portion 20*a* downwardly against the action of the spring 24, so that the pressure rollers 16 and 18 are brought out of contact with the platen 10. In this condition, rotating the upper end of the release lever 32 in the opposite direction to the direction c causes the release arm 28 out of engagement with the engaging portion 20*a* of the retainer 20, whereby the pressure rollers 16 and 18 are urged into pressing contact with the platen 10 by the spring 24.

A paper bail lever 36 is located in the vicinity of the platen 10 and rotatable about a support 34. Paper bail rollers 38 are carried by an upper portion of the paper bail lever 36. Disposed below and engaged with the paper bail lever 36 is a lever 40 which is rotatable about a support shaft 42. The lever 40 is constantly biased couterclockwise by a tension spring 44. The lever 40 is formed with a lug 40*a* at the upper end thereof so that it may be engaged by the paper bail lever 36 in two successive steps. While the paper bail lever 36 is engaged with the underside of the lug 40*a* of the lever 40, it maintains the paper bail rollers 38 in pressing contact with the platen 10 urged by the spring 44.

When the paper bail lever 36 is manually disengaged from the platen 10 at its upper end, its lower end in turn rotates the lever 40 against the action of the spring and, thereby, moves over the lug 40*a* to be engaged by a locking portion 40*b* of the lever 40. This keeps the paper bail rollers 38 apart from the platen 10. Conversely, when the paper bail lever 36 is manually rotated such that the paper bail rollers 38 approach the platen 10 from their spaced position, its lower end rides over the lug 40*a* to be brought into engagement with the underside of the lug 40*a* causing the paper bail rollers 38 to regain the original position, in which they are pressingly engaged with the platen 10.

A projection 32*a* extends from the release lever 32 to be engaged with a lower end portion of the paper bail lever 36. When the release lever 32 is manipulated as indicated by the arrow b in FIG. 2 to space the pressure rollers 16 and 18 from the platen 10, the projection 32*a* rotates the paper bail lever 36 in a direction indicated by an arrow d so that the lower end of the paper bail lever 36*d* rides over the lug 40*a* of the lever 40, also causing the paper bail rollers 38 to be disengaged from the platen 10. It will be noted that the paper bail lever 36 is manipulatable independently of the release lever 32.

An auxiliary guide plate 46 is made of metal or plastic and positioned in the vicinity of the deflector 12. The auxiliary guide plate 46 extends over a length which is substantially the same as the length of the platen 10. A support member 48 retains the auxiliary guide plate 46 and is rigidly mounted on a rotatable shaft 50 at one end thereof. For a predetermined period of time, the auxiliary guide plate 46 is held in a position indicated by a phantom line in FIG. 1 so as to guide the leading end of the paper 14 from the deflector 12 down to the position between the paper bail rollers 38 and the platen 10. Although the auxiliary guide plate 46 is shown as having a curved configuration, any other suitable configuration is usable insofar as it is capable of guiding the sheet 14.

Figure 3:
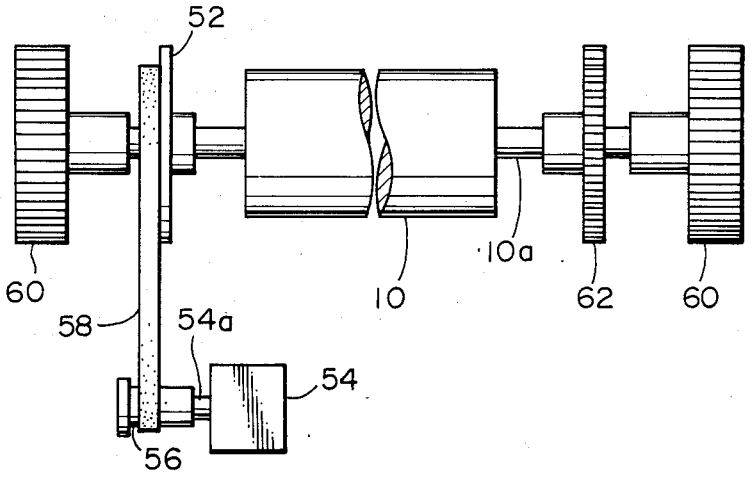

As shown in FIG. 3, the platen 10 is mounted on a rotatable shaft 10*a* which rigidly carries a pulley 52 at one end thereof. Located near the pulley 52 is a stepping motor or like motor 54 having an output shaft 54*a* which carries a pulley 56 therewith. A timing belt 58 is passed over the pulleys 52 and 56 to transmit an output torque of the motor 54 to the shaft 10*a* to rotate it and, thereby, the platen 10 as indicated by an arrow e. The motor 54, pulleys 52 and 56 and timing belt 58 constitute in combination means for causing the platen 10 into rotation. Knob 60 are mounted on opposite ends of the shaft 10*a* which are manipulatable to rotate the platen 10 while the platen 10 is not driven by the motor 54.

Figure 4:
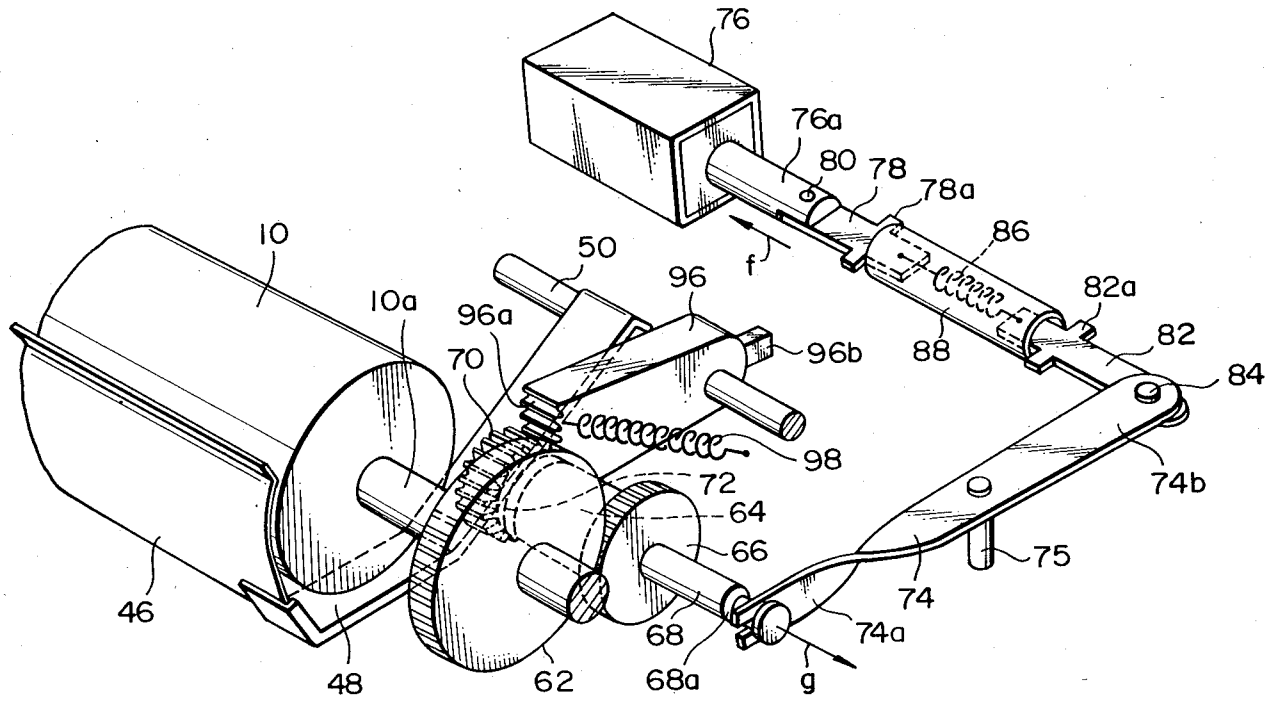
FIG. 4 is a fragmentary perspective view of the sheet feed apparatus shown in FIG. 1.

As shown in FIGS. 3 and 4, a gear element 62 is securely mounted on the shaft 10*a*. A sleeve 64 is positioned adjacent to the gear element 62 and rotatably supported by bearings (not shown). A gear element 66 is securely mounted on the outer periphery of the rotatable sleeve 64 and held in constant mesh with the gear element 62. A shaft 68 slidably extends throughout the sleeve 64 and gear 66. A gear element 70 is rotatable on the slidable shaft 68. A clutch plate 72 is rigidly mounted on that portion of the gear element 70 which faces the sleeve 64.

A lever 74 is pivotable about a support shaft 75 at an intermediate portion thereof and connected at one end 74*a* to an end 68 of the slidable shaft 68. A solenoid 76 is positioned in the neighborhood of the pivotable lever 74. The solenoid 76 has a plunger 76*a* to which a connecting piece 78 is anchored in such a manner as to be rotatable about a fulcrum 80. Another connecting piece 82 is connected to an end 74*b* of the lever 74 adjacent to the solenoid 76 and rotatable about a fulcrum 84. The connecting members 78 and 82 are interconnected by a tension spring 86. Ears 78*a* extend from the opposite sides of the connecting piece 78, and ears 82*a* from the opposite sides of the connecting piece 82. A tube 88 surrounds the spring 86 and part of each of the connecting pieces 78 and 82. So long as a force greater than a predetermined magnitude is not applied to the spring 86, the connecting pieces 78 and 82 are pulled by the spring 86 toward each other so that their ears 78*a* and 82*a* remain in abutment against the opposite edges of the tube 88.

Figure 5:
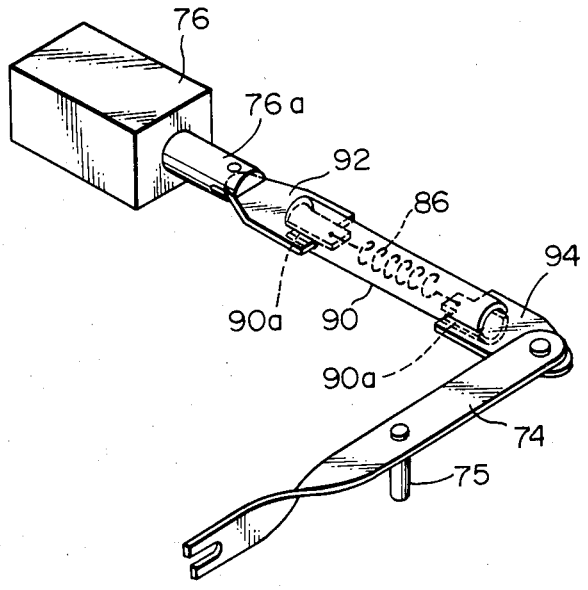
FIG. 5 is a perspective view of a modification to part of the sheet feed apparatus shown in FIG. 4.

A modification to the tube and connecting piece arrangement is shown in FIG. 5. In FIG. 5, a tube 90 is formed with slots 90*a* at opposite ends thereof while the end of each of connecting pieces 92 and 94 adjacent to the tube 90 is provided with a width larger than the outside diameter of the tube 90 and received in the adjacent slots 90*a*. All advantage attainable with this modified configuration is that the connecting pieces 92 and 94 are prevented from being rotated even when the plunger 76*a* of the solenoid 76 is moved.

A rotary member 96 neighbors the gear 70 and is securely mounted on the shaft 50 to which the retainer 48 retaining the auxiliary guide plate 46 is fixed. The toothed member 96 has teeth 96*a* formed at its end which is remote from the shaft 50, the teeth 96*a* being meshed with the gear 70. In this construction, a rotation of the gear 70 causes the rotary member 96 and, thereby, the shaft 50 to rotate. The shaft 50 in turn drives the retainer 48 and auxiliary guide plate 46 fixed thereto in an angular movement.

As the rotary member 96 is caused to rotate by the gear 70 to in turn move the auxiliary guide plate 46 toward the paper bail rollers 38, a stop 96*b* extending from the rear end of the rotary member 96 abuts against the stationary member 22 to prevent any further movement of the auxiliary guide plate 46. In this position, the auxiliary guide plate 46 is spaced small distance from the platen 10. While the stop 96*b* remains in engagement with the stationary member 22 to maintain the member 96 unmovable and the solenoid 76 is energized to hold the clutch plate 72 in pressing contact with the rotatable sleeve 64, any rotation of the gear 66 is ineffective to rotate the gear 70 because the clutch plate 72 and the sleeve 64 simply slips on each other. A return spring 98 is anchored at one end to the retainer 48 and at the other end to the stationary member 22. When the solenoid 76 is deenergized to space the clutch plate 72 of the gear 70 from the rotatable sleeve 64, the return spring 98 will pull the retainer 48 to thereby rotate the auxiliary guide plate 46 downwardly. As the retainer 48 is rotated by the return spring 98, the shaft 50 is also rotated to return its associated member 96 to the inoperative position.

Figure 6:
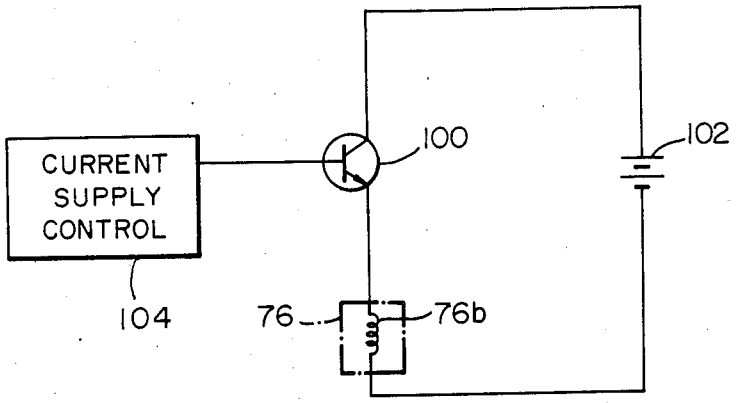
FIG. 6 is an electric circuit diagram adapted for controlling the operation of the sheet feed apparatus shown in FIGS. 1–5.
Figure 7:
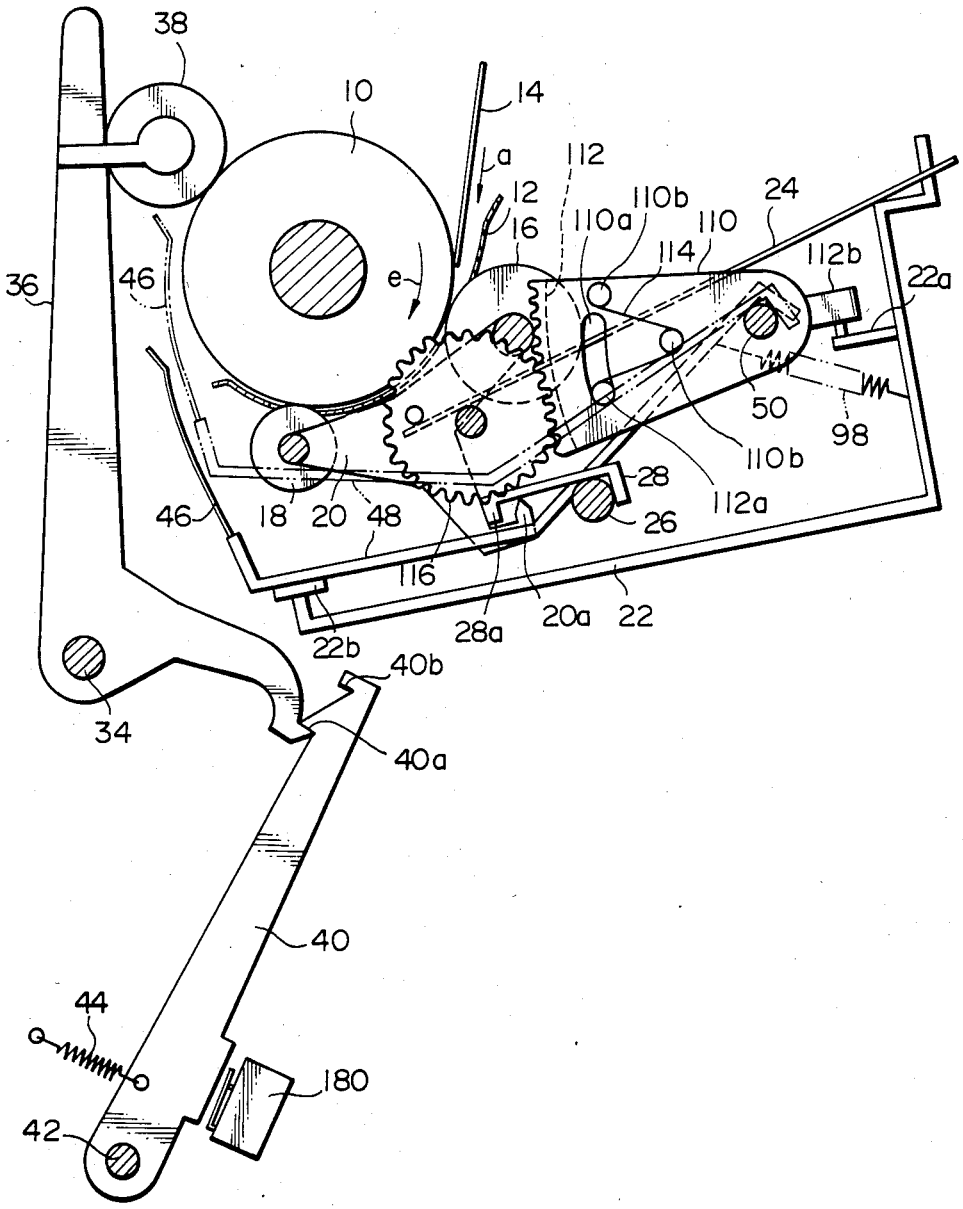
FIG. 7 is a fragmentary side elevation of a second embodiment of the present invention.
Figure 8:
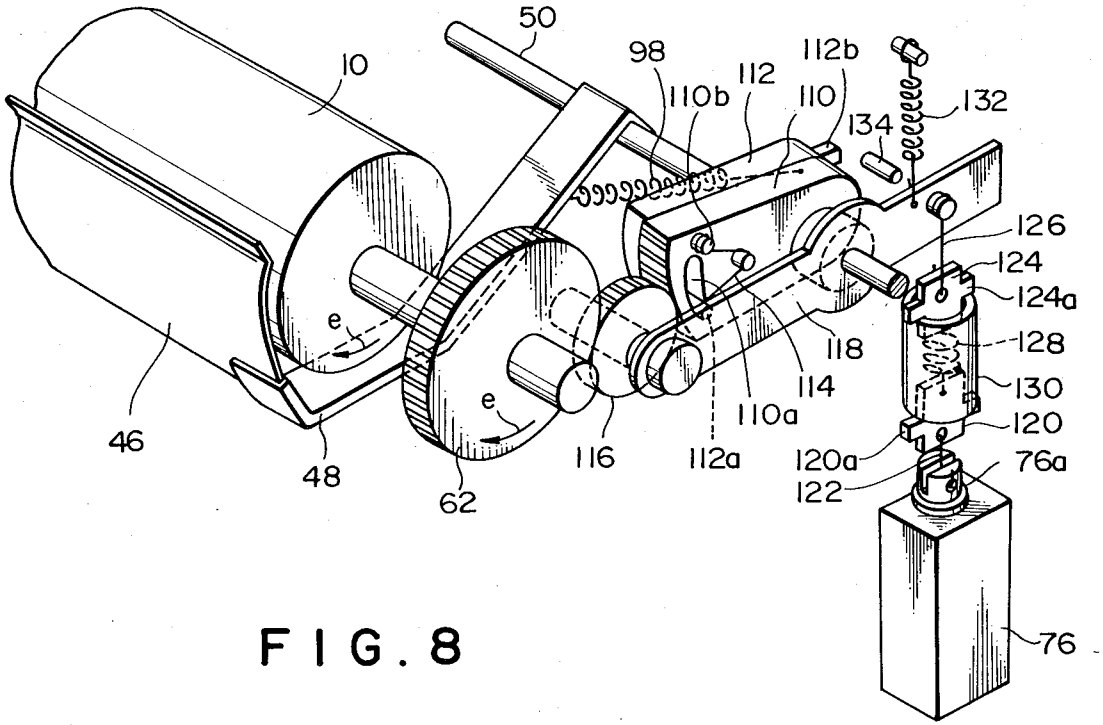
FIG. 8 is a perspective view of part of the sheet feed apparatus shown in FIG. 7.

As shown in FIG. 6, a coil 76*b* the solenoid 76 and a transistor 100 are connected in series with a DC power source 102. The base of transistor 100 is connected to an output terminal of a current supply control circuit 104. A function assigned to the current supply control circuit 104 is increasing the voltage applied to the base of the transistor 100 momentarily for a predetermined period of time so as to turn on the transistor 100, thereby supplying a current to the coil 76*b* of the solenoid 76. Upon the energization of the solenoid 76, the plunger 76*a* is moved in a direction indicated by an arrow f in FIG. 4. Such a movement of the plunger 76*a* is transmitted to the lever 74 via the connecting piece 78, spring 86 and connecting piece 82 so that the lever 74 is angularly moved to cause the shaft 68 to slide as indicated by an arrow g. Then, the clutch plate 72 integral with the gear 70 is brought into pressing contact with the sleeve 64 with the result that the rotation of the gear 66 is transmitted to the gear 70 by the frictional contact between the clutch plate 72 motion.

An arrangement is made such that, when the solenoid coil 76*b* is energized to move the plunger 76*a* in the direction f, the lever 74 is rotated to move the slidable-shaft 68 in the direction g to thereby urge the clutch plate 72 into contact with the sleeve 64 and, thereafter, the plunger 76*a* is further moved a predetermined distance to stretch the spring 86 such that the ears 78*a* of the connecting piece 78 become spaced from the tube 88 by a predetermined amount. Therefore, the clutch plate 72 is held in pressing contact with the sleeve 64 by the tension exerted by the spring 86.

Where the solenoid plunger 76*a* is directly connected to the lever 74 to rotate the latter, in place of the indirect connection shown and described, any change in the stroke of the solenoid plunger 76*a* due to wear of the clutch plate 72 will vary the torque transmitted by the clutch plate 72 and, because the variation of the torque transmitted by the clutch plate 72 is substantial although the change in the stroke of the plunger 76*a* may be small, the function of the clutch plate 72 is apt to be deteriorated.

In accordance with the present invention, the solenoid plunger 76*a* is connected to the lever 74 by way of the spring 86 and, after the plunger 76*a* has been moved to move the clutch plate 72 into pressing contact with the sleeve 64, the clutch plate 72 is kept in pressing contact with the sleeve 64 by the tension ofthe spring 86. Therefore, although the clutch plate 72 may wear to vary the stroke of the solenoid plunger 76*a*, the tension of the spring 86 remains substantially unchanged in turn maintaining the torque transmitted by the clutch plate 72 substantially constant. This allows a minimum of deteriorization to occur in the function of the clutch plate 72.

Upon deenergization of the solenoid 76, the solenoid plunger 76*a* is urged by a spring (not shown) to move the slide shaft 68 in the direction opposite to the direction g. As a result, the clutch plate 72 on the gear 70 is disengaged from the sleeve 64 to interrupt the transmission of the torque from the gear 66 to the gear 70.

Referring to FIGS. 7–12, a second embodiment of the sheet feed apparatus of the present invention is shown. In these drawings, the same or similar structural elements as those of the first embodiment are designated by like reference numerals. As shown, a sector gear 110 is positioned at a predetermined spacing from the gear 62 which is mounted on the shaft 10*a* of the platen 10. A rotatable member 112 is fixedly mounted on the shaft 50 which carries the auxiliary guide plate 46 therewith. The sector gear 110 is rotatably supported by a boss which extends from the rotatable member 112. The sector gear 110 is formed with a slot 110*a* while a projection 112*a* extends from a side surface of the member 112 to be received in the slot 110*a*. Two projections 110*b* extend from a common side surface of the sector gear 110. A spring 114 is anchored to the projections 110*b* and the projection 112*a* such that, considering the member 112 as a reference, the spring 114 constantly biases the sector gear 110 upwardly.

The sector gear 110 is formed with teeth in its portion which faces the gear 62. An idle gear 116 is engageable with the gear 62 and the sector gear 110 and mounted on a shaft which is retained by one end of a lever 118. The lever 118 is rotatably mounted on the shaft 50 at an intermediate portion thereof. The solenoid 76 is located below the other end of the lever 118.

A connecting piece 120 is connected to the plunger 76*a* of the solenoid 76 by a wire 122. Another connecting piece 124 is connected to an end portion of the lever 118 by a wire 126. The connecting pieces 120 and 124 are interconnected a tension spring 128. Ears 120*a* extend from opposite sides of the connecting piece 120, and ears 124*a* from those of the connecting piece 124. A tube 130 surrounds the spring 128 and part of each of the connecting pieces 120 and 124. So long as a force greater than predetermined one which tends to stretch the spring 128 is not applied to the spring 128, the connecting pieces 120 and 124 are pulled toward each other by the spring 128 with their ears 120*a* and 124*a* respectively abutted against the opposite edges of the tube 130. A tension spring 132 is retained by an end portion of the lever 118 adjacent to the solenoid 76 so as to bias the lever end portion upwardly. A stop 134 is located above the end portion of the lever 118 which neighbors the solenoid 76.

Figure 9:
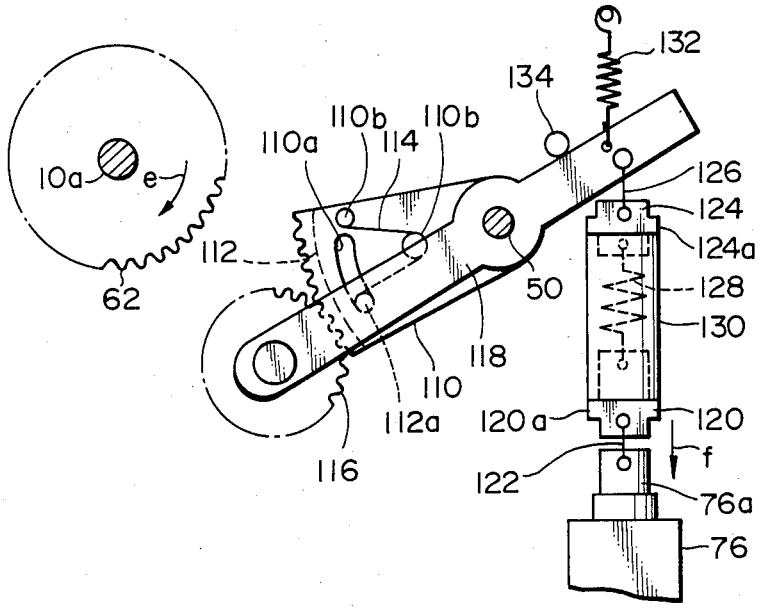
FIGS. 9–12 are views representative of various operating positions of the sheet feed apparatus shown in FIGS. 7 and 8.

Before the solenoid 76 is energized, as shown in FIG. 9, the lever 118 is held in abutment against the stop 134 by the spring 132 and the idle gear 116 on the lever 118 is kept disengaged from the gear 62 and sector gear 110.

Figure 10:
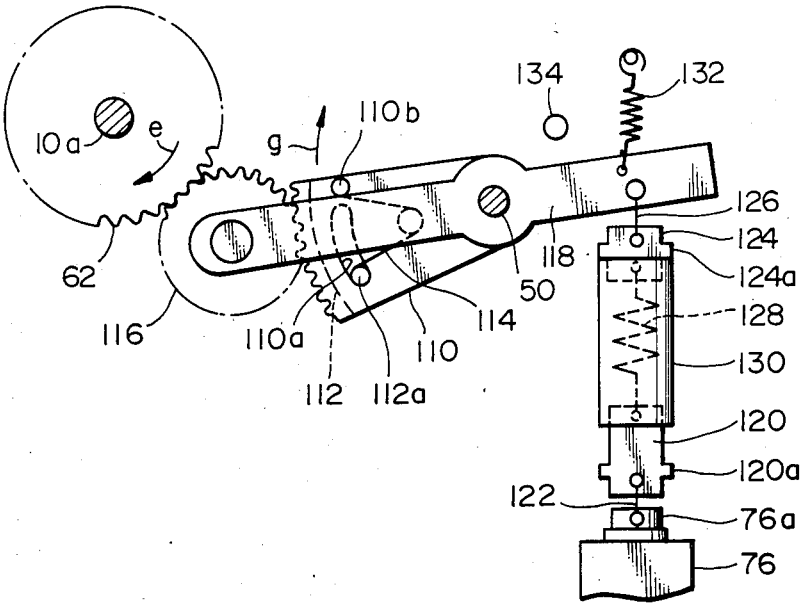

As soon as the solenoid 76 is energized, the plunger 76*a* is moved as indicated by an arrow f and this movement is transmitted to the lever 118 via the wire 122, connecting piece 120, spring 128, connecting piece 124 and wire 126, thereby rotating the lever 118 clockwise against the action of the spring 132. The idle gear 116, therefore, is brought into mesh with the gear 62 and sector gear 110 as shown in FIG. 10. In this instance, the ears 120*a* of the connecting piece 120 are spaced downwardly from the edge of the tube 130 so that the idle gear 116 is kept in mesh with the gear 62 and sector gear 220 by the tension of the spring 128.

When the idle gear 116 is meshed with the gear 62 and the sector gear 110 as described above, the torque developed by the gear 62 which is rotating in the direction e is imparted by the idle gear 116 to the sector gear 110 which is then driven in the direction g shown in FIG. 10. The sector gear 110 urges the projection 112*a* to angularly move the member 112 in the direction g against the action of the return spring 98. This causes the shaft 50 to rotate to move the auxiliary guide plate 46 toward the platen 10 and paper bail rollers 38, as shown in FIG. 11.

As the auxiliary guide plate 46 approaches the platen 10 and paper bail rollers 38 in unison with such a movement of the sector gear 110, a stop 112*b* extending from the rear end of the member 112 abuts against an abutment 22*a* of the stationary member 22 to prevent any further movement of the auxiliary guide plate 46. In this position, the auxiliary guide plate 46 is spaced a small distance from the platen 10. Even after the auxiliary guide plate 46 has been so positioned with the stop 112*b* engaged with the abutment 22*a*, the gear 62 integral with the platen 10 continuously rotates in the direction e. However, because the sector gear 110 has been restrained by the projection 112*a* on the then stationary member 112, there repeats an occurrence that the gear 62 moves the idle gear 116 as indicated by an arrow h against the force of the spring 128 so as to temporarily interrupt the engagement between the gear 62 and the idle gear 116 and, then, it allows the idle gear 116 to restore the interengagement due to the tension exerted by the spring 128. Therefore, the sector gear 110, member 112, and auxiliary guide plate 46 are maintained stationary in their predetermined positions.

Figure 12:
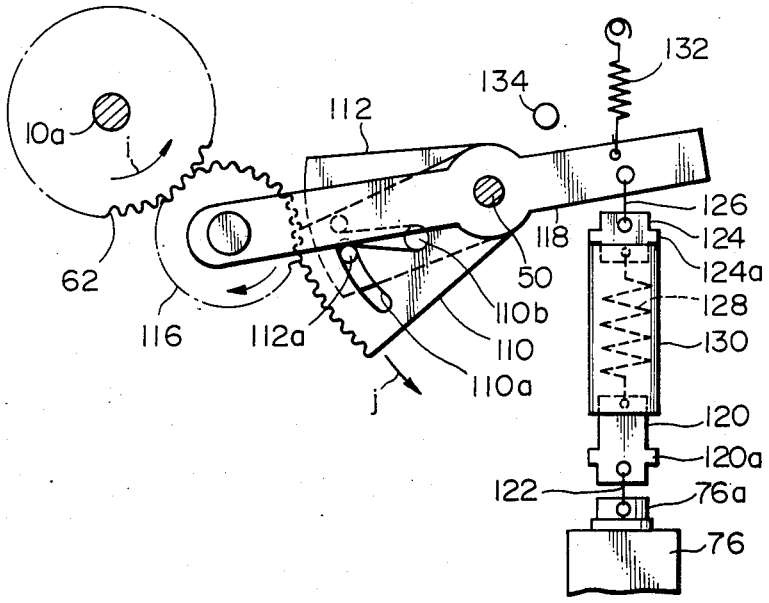

As shown in FIG. 12, assume that the gear 62 is rotated in a direction indicated by an arrow i while the solenoid 76 is energized and the idle gear is meshed with the gear 62 and section gear 110. Then, the rotation of the gear 62 is imparted to the sector gear 110 via the idle gear 116 causing the sector gear 110 into rotation as indicated by an arrow j. The auxiliary guide plate 46 is then moved downwardly by the return spring 98 until it becomes stopped by a damper 22*b*, which is integral with the stationary member 22. This also interrupts the movement of the shaft 50 and member 112. In this condition, although the projection 112*a* of the member 112 shifts itself to an upper portion of the slot 110*a* of the sector gear 110, the idle gear 116 is brought out of mesh with the sector gear 110 before the projection 112*a* abuts against the upper edge of the slot 110*a*, thereby preventing the rotation of the idle gear 116 from being transmitted to the sector gear 110.

Figure 11:
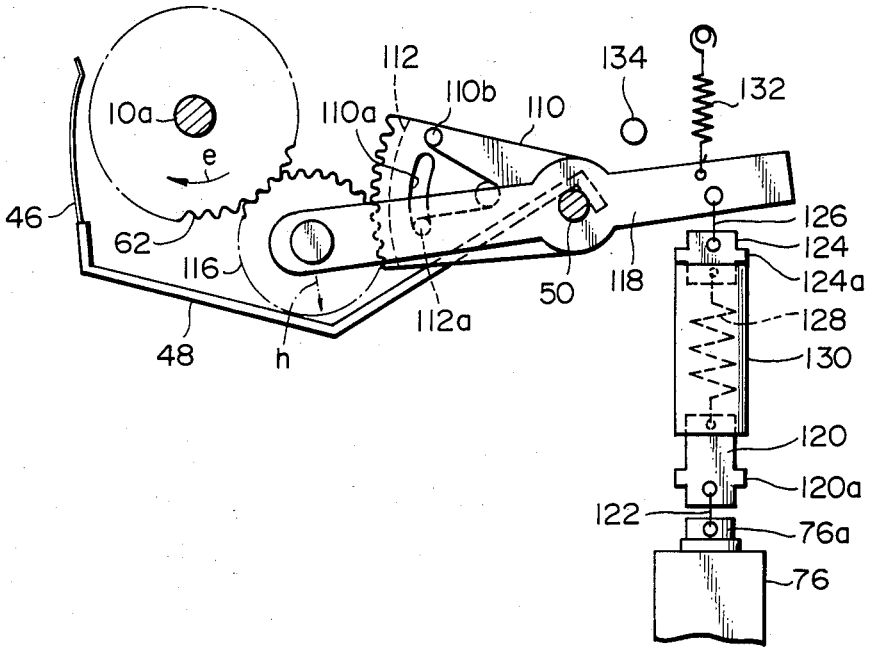

As shown in FIG. 11, when the current supply to the solenoid 76 is interrupted, the spring 132 causes the lever 118 to rotate counterclockwise by its tension so that the idle gear 116 is disengaged from the gear 62 and sector gear 110 as shown in FIG. 9. Then, the auxiliary guide plate 46 is moved downwardly by the tension of the return spring 98 until it comes into abutment against the damper 22*b* of the stationary member 22. The downward movement of the auxiliary guide plate 46 is accompanied by those of the member 112 and the sector gear 110. Also, the movement of the member 112 and sector gear 110 is interruped upon interruption of movement of the auxiliary guide plate 46 by the damper 22*b*.

Figure 13:
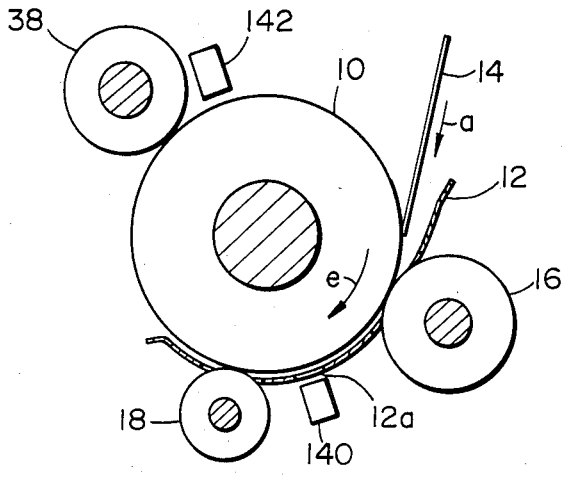
FIG. 13 is a view of a sensor arrangement additionally installed in the first or second embodiment.

In the first or second embodiment shown and described, a first sheet sensor 140 is located between the pressure rollers 16 and 18 around the platen 10, as shown in FIG. 13. Part of the deflector 12 which is positioned between the first sheet sensor 140 and the platen 10 is formed with an opening 12*a* for passing light therethrough. A second sheet sensor 142 is located around the platen 10 past the paper bail rollers 38 with respect to the feed direction of the sheet 14. Each of the first and second paper sensors 140 and 142 comprises a light emitting element and a light receiving element which are arranged such that light issuing from the light emitting element is reflected by the platen 10 or the sheet 14 to become incident to the light receiving element. Generally, the platen 10 is colored black and the sheet 14, white and, therefore, the intensity of reflection from the paper 14 is greater than that from the platen 10. The light receiving element of each paper sensor 140 or 142 is constructed, for example, to generate a low voltage in response to light reflected by the platen 10 and a high voltage in response to light reflected by the sheet 14.

Figure 14:
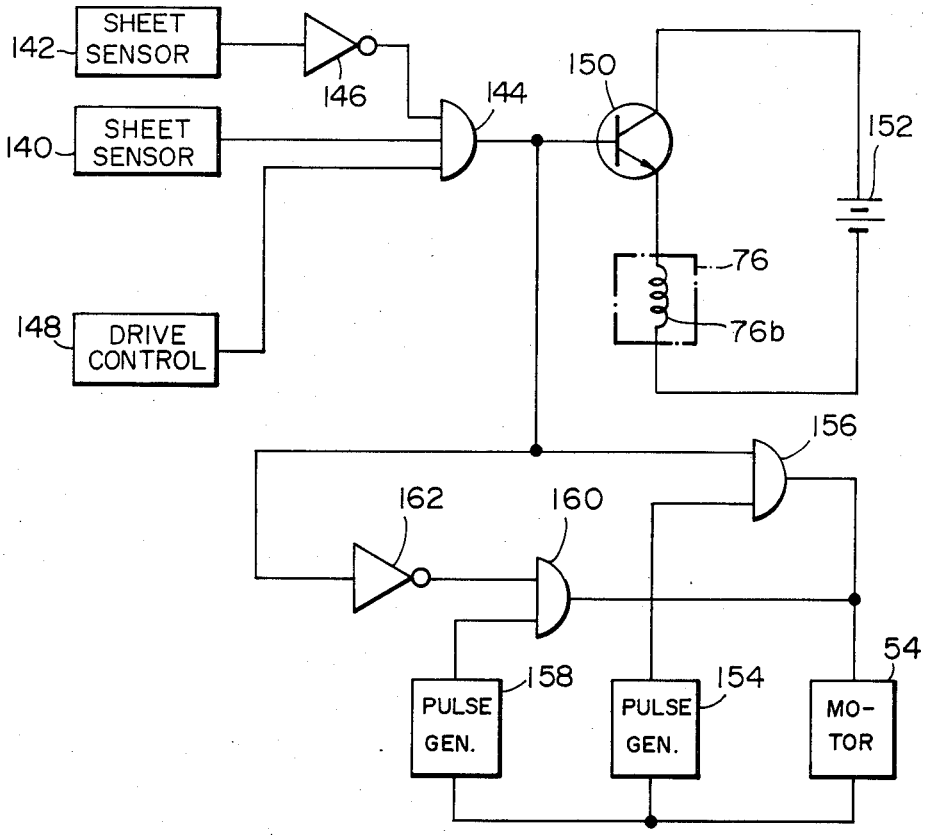
FIG. 14 is an electric circuit diagram adapted for controlling the operation of the sheet feed apparatus of FIG. 13.

Referring to FIG. 14, an example of a control over the power supply to the motor 54 and solenoid 76 is shown which occurs on the basis of output voltages of the sheet sensors 140 and 142.

Figure 15:
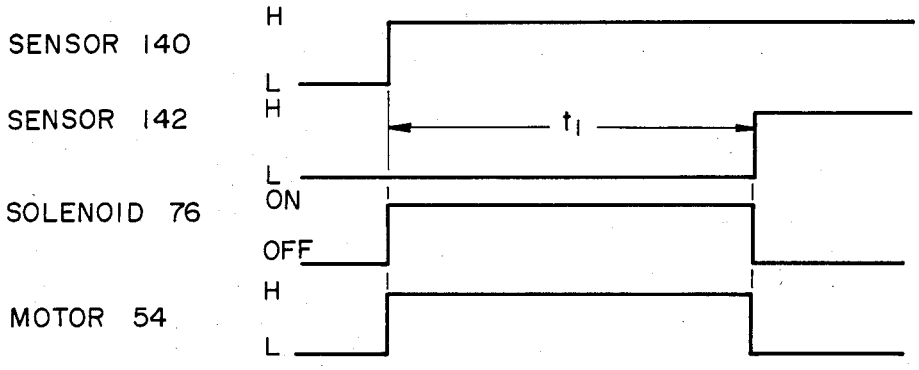
FIG. 15 is a timing chart demonstrating the operation of the electric circuitshown in FIG. 14.

In FIG. 14, the output terminal of the sheet sensor 140 is connected to an input terminal of an AND gate 144. The output terminal of the sheet sensor 142 is connected to another input terminal of the AND gate 144 via an inverter 146. Connected to another input terminal of the AND gate 144 is an output terminal of a drive control cicuit 148. The output terminal of the AND gate 144 is connected to the base of a transistor 150. The transistor 150 and the coil 76*b* of the solenoid 76 are connected in series to a DC power source 152. Only under the condition wherein the output voltage of the paper sensor 140 is high and that of the paper sensor 142 is low while a high voltage is appearing from the drive control circuit 148, a high voltage is applied from the AND gate 144 to the base of the transistor 150 to turn on the transistor 150 so that a current is supplied to the coil 76*b* 76 the solenoid 76. Therefore, the solenoid coil 76*b* is kept energized only for a period of time $t_1$ from the instant of movement of the leading end of the sheet 14 past the paper sensor 140 to the instant of movement of the same past the sheet sensor 142, as shown in FIG. 15.

A pulse generator 154 is connected to the motor 54 via and AND gate 156. Another pulse generator 158 is connected to the motor 54 via another AND gate 160 in parallel with the pulse generator 154. The frequency of pulses output from the pulse generator 154 is lower than the frequency of pulses output from the other pulse generator 158. Connected to another input terminal of the AND gate 156 is the output terminal of the AND gate 144. Connected to another input terminal of the AND gate 160 via an inverter 162 is the output terminal of the AND gate 144.

While a high voltage is produced from the output terminal of the AND gate 144, the AND gate 156 is enabled and the AND gate 160 is disenabled so that the pulses output from the pulse generator 154 are delivered to the motor 54. Conversely, while a low voltage is produced from the AND gate 144, the AND gate 156 is disenabled and the AND gate 160 is enabled, thereby routing output pulses of the pulse generator 158 to the motor 54. The motor 54 is of the type whose output torque increases with the decrease in the frequency of input pulses.

Therefore, the output torque of the motor 54 remains larger for the time period $t_1$ from the instant of movement of the leading end of the sheet 14 past the sheet sensor 140 to the instant of movement of the same past the sheet sensor 142, while remaining small for the other period. This is to cope with an occurrence in the time period $t_1$ that due to energization of the solenoid 76 the clutch plate 72 of the rotation means is coupled to impart the rotation of the motor 54 to the drive means, resulting in an increase in the load acting on the motor 54.

Another example of the power supply control to the motor 54 and solenoid 76 based on the output voltage of the paper sensors 140 and 142 will be described with reference to FIG. 16.

Figure 17:
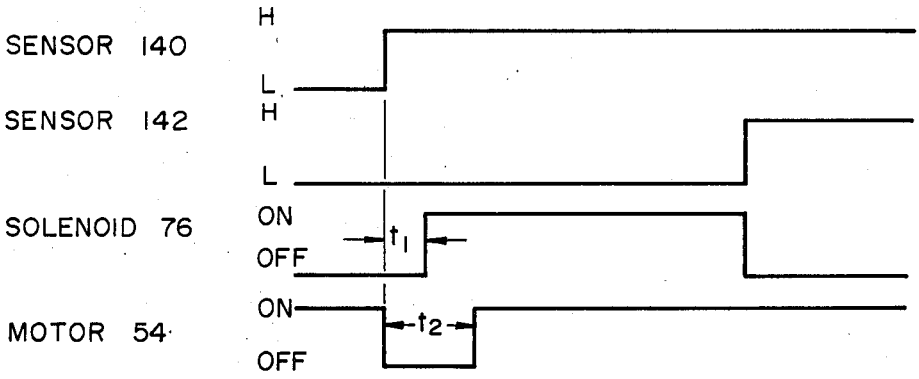
FIG. 17 is a timing chart demonstrating the operation of the electric circuit shown in FIG. 16.
Figure 16:
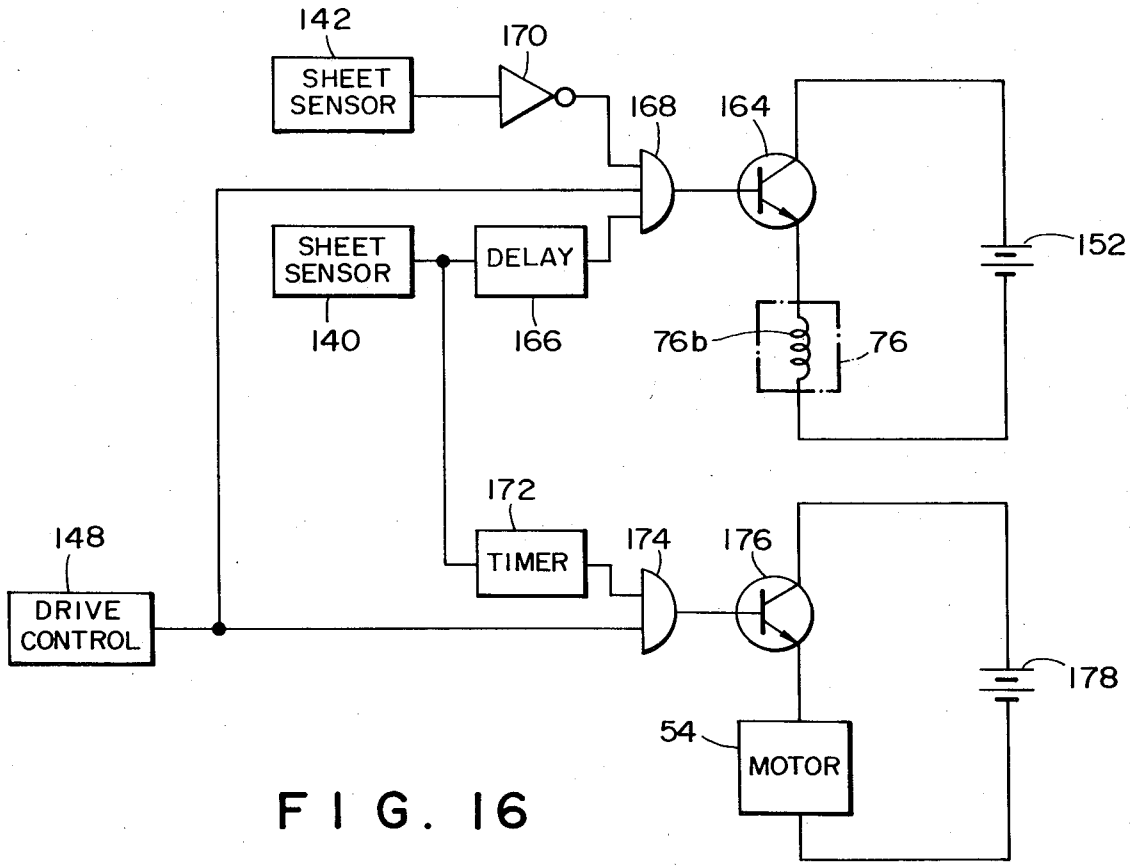
FIG. 16 is an electric circuit diagram adapted for controlling the operation of the sheet feed apparatus shown in FIG. 13.

In FIG. 16, the coil **76*b* of the solenoid 76 and a transistor 164 are connected in series to the DC power source 152. The output terminal of the sheet sensor 140 is connected to an input terminal of an AND gate 168 via a delay circuit 166. The delay circuit 166 functions to delay an output voltage of the sheet sensor 140 by a time $t_1$ as shown in FIG. 17 before the output voltage reaches the AND gate 168. The output terminal of the sheet sensor 142 is connected to another input terminal of the AND gate 168 via an inverter 170. Further connected to another input terminal of the AND gate 168 is the drive control circuit 148 which is adatped to generate a high voltage during operation of the printer. The output of the AND gate 168 is connected to the base of the transistor 164. In this construction, only when a high voltage appears from the output terminal of the paper sensor 140 and is routed through the delay circuit 166 to the AND gate 168 and a low voltage appears from the paper sensor 142 while a high voltage is appearing from the output terminal of the drive control 148, the AND gate 168 applies the high voltage to the base of the transistor 164 to turn on the transistor 164 to thereby supply a current to the solenoid coil 76*b*. That is, the solenoid coil 76*b* is kept energized only from the instant when a time $t_1$ has lapsed after the movement of the leading end of the sheet past the sensor 140 over to the instant when it moves past the sheet sensor 142**.

The output terminal of the sheet sensor 140 is connected to an input terminal of a timer 172 an output terminal of which is in turn connected to an input terminal of an AND gate 174. Only when received a high voltage from the sheetsensor 140, the timer 172 generates a low voltage only for a time $t_2$ from that instant as shown in FIG. 17. Connected to another input terminal of the AND gate 174 is the output terminal of the drive control circuit 148. The output of the AND gate 174 is connected to the base of a transistor 176. The transistor 176 and the motor 54 are connected in series to a DC power source 178. The timer 172, therefore generates a low voltage for the time $t_2$ from the instant when the output of the sheet sensor 140 has changed from a low voltage to a high voltage while the drive control 148 is producing a high voltage. For that time period, the AND gate 174 remains closed so that the low voltage is applied to the base of the transistor 176 to turn it off, thereby supplying no current to the motor 54. Meanwhile, for the period other than $t_2$, the timre 172 produces a high voltage to enable the AND gate 174 and, hence, the high voltage is applied to the base of the transistor 176 to turn it on causing a current supply to the motor 54 to occur.

The outputs of the paper sensors 140 and 142 and the operations of the solenoid 76 and motor 54 will be described with respect to time with reference to FIG. 17.

The solenoid 76 is turned on at an instant when the time $t_1$ has expired after the buildup of the output of the sheet sensor 140 from a low voltage to a high voltage, and turned off at the succeeding buildup of the output of the paper sensor 142 from a low voltage to a high voltage. The motor 54 is deenergized only for the time $t_2$ after each buildup of the output of the sheet sensor 140.

The solenoid 76 is energized upon the lapse of the time $t_1$ after the deenergization of the motor 54 because, in the first embodiment described, the platen 10, gears 62 and 66 and sleeve 64 contiue to rotate for a short period of time due to inertia even after the energization of the motor 54, that is, in order to deenergize the solenoid 76 after the stop of rotation of the platen 10, gears 62 and 66 and sleeve 64. The time $t_2$ for which the motor 54 remains deenergized is selected to be long enough for the clutch plate 72 to be pressed against the sleeve 64 after energizations of the solenoid 76.

Therefore, the platen 10, gears 62 and 66 and sleeve 64 are stopped at a predetermined time at which the clutch plate 72 is fully coupled with the sleeve 64 after the start of a current supply to the solenoid 76. Should the sleeve 64 be rotating in the event of coupling of the clutch 72 with the sleeve 64, only a dynamic friction force would act between them at an initial stage of coupling tending to cause the clutch plate 72 and the sleeve 64 to slip on each other. Thus, in the illustrative embodiment, the sleeve 64 is held in a halt before coupling the clutch plate 72 therewith so as to develop a static friction force therebetween.

Hereinafter will be described an operation for feeding the sheet 14 by an automatic sheet feeder and by gravity to between the platen 10 and the deflector 12, taking for example a case wherein the platen 10 is driven by the motor 54.

Referring again to FIGS. 1 and 4, the pressure rollers 16 and 18 and the paper bail rollers 38 are kept in pressing contact with the platen 10. As the sheet 14 is inserted between the platen 10 and the deflector 12, it is moved to between the platen 10 and the pressure rollers 16 and 18 by the rotation of the platen 10 driven by the motor 54 and the friction acting between the platen 10 and the sheet 14. At this instant, a current supply to the solenoid 76 is initiated. The rotation of the platen shaft **10*a* is transmitted to the shaft 50 via the gears 62 and 66, sleeve 64, clutch plate 72, gear 70 and member 96. The resulting rotation of the shaft 50 shifts the auxiliary guide plate 46 from the solid line position to the phatom line position shown in FIG. 1. Concerning the case shown in FIGS. 7 and 8, the rotation of the platen 10 is imparted to the shaft 50 via the gear 62, idle gear 116, sector gear 110, lug 112*a* and member 112. In the phantom line position, the auxiliary guide plate 46** faces substantially the whole peripheral region of the platen 10 between the deflector 12 and the paper bail rollers 38. Before the leading edge of the sheet 14 travelling between the platen 10 and the pressure rollers 16 and 18 moves clear of the platen 10 and the deflector 12, the auxiliary guide plate 46 gains the phantom line position.

Next, the end of the sheet 14 fed by the rotation of the platen 10 while being held between the platen 10 and the pressure rollers 16 and 18 is guided by the guide plate 46 into the gap between the paper bail rollers 38 and the platen 10. After the sheet 14 has been inserted between the paper bail rollers 38 and the platen 10 over a predetermined length, that is, after the leading end portion of the sheet14 has been laid on the platen 10, the solenoid 76 is deenergized so that the auxiliary guide plate 46 is moved downwardly by the return spring 98 to regain the original or inoperative position indicated by the solid line, in which it is spaced apart from the paper bail rollers 38 and the deflector 12. Under this condition, an ink jet printer or like printer is actuated to print out desired data on the sheet 14 on the periphery of the platen 10 between the paper bail rollers 38 and the deflector 12. During the printing operation, the platen 10 is rotated intermittently or continuously in the direction e to feed the paper 14.

The auxiliary guide plate 46 may have flexibility and be arranged to press its upper end portion against the platen 10 when moved upward toward the paper bail rollers 38. Further, the energization of the solenoid 76 may be started when the leading edge of the sheet 14 has reached the leading end of the deflector 12 after the start of a feed of the sheet 14 by the platen 10, thereby causing the guide plate 46 to move upwardly together with the leading edge of the sheet 14.

Next, the operation will be described in conjunction with manual insertion of the sheet 14 toward the platen 10.

First, the release lever 32 and paper bail lever 36 are manually moved to space the pressure rollers 16 and 18 and paper bail rollers 38 from the platen 10. A microswitch 180 is located in the vicinity of the lever 40 which is engaged with the paper bail lever 36. When the paper bail lever 36 is manipulated to move the paper bail rollers 38 away from the platen 10, an actuator associated with the microswitch 180 is operated by the lever 40 so that the microswitch 180 closes a power source circuit for energizing the solenoid 76.

Thereafter, the knob 60 is manually rotated to rotate the platen 10 in the direction e while inserting the sheet 14 between the platen 10 and the deflector 12. Then, because the solenoid 76 has been energized, the rotation of the platen shaft 10*a* is imparted to the shaft 50 via the gears 62 and 66, sleeve 64, clutch plate 72, gear 70 and member 95 (in the case shown in FIGS. 7 and 8, via the gear 62, idle gear 116, sector gear 110, lug 112*a* and member 112). This shifts the auxiliary guide plate 46 from the solid line position to the phantom line position in FIG. 1, thereby guiding the sheet 14 fed by the platen 10 toward the paper bail rollers 38 and the platen 10. After the sheet has been inserted between the paper bail rollers 38 and the platen 10 and then adjusted in position, the paper bail lever 36 and release lever 32 are rotated to press the paper bail rollers 38 and pressure rollers 16 and 18 against the platen 10. As the paper bail lever 36 is moved in a direction to bring the paper bail rollers 38 toward the platen 10, the lever 40 disengages the actuator of the microswitch 180 to cause the microswitch 180 to open the power supply circuit for the solenoid 76 and, as a result, the current supply to the solenoid 76 is interrupted. Then, the auxiliary guide plate 46 is moved by the return spring 98 from the phantom line position to the solid line position in FIG. 1.

It should be noted that the rotation means shown and described for rotating the auxiliary guide plate 46 and the retainer 48 which retains the guide 46 is only illustrative. The gist is that such means should only impart the rotation of the platen 10 to the retainer 48 for the guide 46 by transmission means which at least includes the clutch plate 72, and controls the coupling and uncoupling movements of the clutch plate 72 by a solenoid.

The present invention is smilarly applicable to a sheet feed apparatus in which the drive means comprises a servo motor, a DC motor, an induction motor or a syncronous motor, for example.

In summary, it will be seen that a sheet feed apparatus for a printer of the present invention is capable of surely laying a paper on a platen because it allows an auxiliary guide plate for guiding the paper from a deflector to between paper bail rollers and the platen to cover substantially the whole periphery of the platen between the deflctor and the paper bail rollers while guiding a leading end portion of the paper.

Because the means for rotating the auxiliary guide plate employs a solenoid control for coupling and uncoupling movements of a clutch plate and a solenoid plunger and the cutch plate are interconnected by a spring, the clutch plate is hardly susceptive to deterioration and, therefore, durable.

Futher, the motor is effectiely used because the motor output is made greater when the solenoid is energized than when it is deenergized.

The rotation of the platen is interrupted from the start of energization of thesolenoid over to full coupling of the clutch plate. This insures coupling of the clutch plate and, additionally, prevents wear of the clutch plate to enhance the service life.

The durability is further enhanced by the fact that when the rotation means drives the auxiliary guide plate in a rotational motion, no large force acts on the rotation means and a minimum of wear is allowed to develop.

Various modifications will become possible for those skilled in the art after receiving the teachings of the present disclosure without departing from the scope thereof.

What is claimed:

1. A sheet feed apparatus for a printer which lays a sheet to print out data on a rotatable platen, comprising:

platen drive means for rotating the platen;

a deflector for guiding the sheet along a periphery of the platen;

a paper bail roller for pressing the paper against the periphery of the platen;

a guide member movable to face the periphery of the platen between the paper bail roller and the deflector;

guide member drive means for integrally holding said guide member and moving the guide member toward and away from the periphery of the platen;

control means for controlling the guide member drive means such that, after the guide member is moved toward the periphery of the platen to face a substantially whole area of the periphery of the platen between the paper bail roller and the deflector, the paper guide member is moved away from the periphery of the platen when a leading end of the sheet guided from the deflector to the paper bail roller is held between the paper bail roller and the platen; and the guide member drive means comprising a transmission mechanism for transmitting a rotation of the platen to the guide member.

2. A sheet feed apparatus as claimed in claim 1, in which the transmission mechanism comprises a first gear rotatable integrally with the platen, a second gear meshing with said first gear, a third gear engagable with said second gear, clutch means for coupling and uncoupling the second and third gears to and from each other, and a pivotable member integral with the guide member and pivotable in engagement with the third gear.

3. A sheet feed apparatus as claimed in claim 2, in which the control means comprises solenoid means for controlling coupling and uncoupling motions of the clutch means, and connecting means for interconnecting said solenoid means and the clutch means.

4. A sheet feed apparatus as claimed in claim 3, in which the connecting means comprises a spring.

5. A sheet feed apparatus as claimed in claim 3, in which the platen drive means comprises a motor.

6. A sheet feed aparatus as claimed in claim 5, in which the motor comprises at least one of a stepping motor, a servo motor, a DC motor, an induction motor and a synchronous motor.

7. A sheet feed apparatus as claimed in claim 6, in which the control means further comprises means for drivably controlling the motor such that an output of the motor is larger when the solenoid means is energized than when the solenoid means is deenergized.

8. A sheet feed apparatus as claimed in claim 6, in which the control means further comprises means for drivably controlling the motor such that the rotation of the platen is interrupted for a predetermined period of time from a start of energization of the solenoid means to an end of coupling of the clutch means.

9. A sheet feed apparatus as claimed in claim 1, in which the transmission mechanism comprises a drive gear integrally rotatable with the platen, a sector gear pivotable integrally with the guide member, and an idle gear engagable with said drive gear and said sector gear.

10. A sheet feed apparatus as claimed in claim 9, in which the control means comprises solenoid means for controlling coupling and uncoupling between the drive gear and the sector gear which is caused by the idle gear, and connecting means for interconnecting the solenoid means and the idle gear.

11. A sheet feed apparatus as claimed in claim 10, in which the connecting means comprises a spring.

12. A sheet feed apparatus as claimed in claim 10, in which the platen drive means comprises a motor.

13. A sheet feed apparatus as claimed in claim 12, in which the motor comprises at least one of a stepping motor, a servo motor, a DC motor, an induction motor and a synchronous motor.

14. A sheet feed apparatus as claimed in claim 13, in which the control means further comprises means for drivably controlling the motor such that an output of the motor is larger when the solenoid means is energized than when the solenoid means is deenergized.

15. A sheet feed apparatus as claimed in claim 13, in which the control means further comprises means for drivably controlling the motor such that the rotation of the platen is interrupted for a predetermined period of time from a start of energization of the solenoid means to an end of coupling of the clutch means.

* * * * *